US005944541A

United States Patent [19]

Payne

[11] Patent Number: 5,944,541

[45] Date of Patent: Aug. 31, 1999

[54] INTERLEAVED POWER AND IMPEDANCE CONTROL USING DAUGHTERCARD EDGE CONNECTOR PIN ARRANGEMENT

[75] Inventor: Warren Payne, Petalluma, Calif.

[73] Assignee: Alcatel USA, Plano, Tex.

[21] Appl. No.: 08/996,116

[22] Filed: Dec. 23, 1997

[51] Int. Cl.[6] ..... H01R 4/66

[52] U.S. Cl. ..... 439/108

[58] Field of Search ..... 439/101, 108

[56] References Cited

U.S. PATENT DOCUMENTS

| | | | |
|---|---|---|---|
| 4,869,676 | 9/1989 | Demler, Jr. et al. | 439/101 |
| 4,881,904 | 11/1989 | Ammon et al. | 439/101 |
| 5,161,991 | 11/1992 | Bauer | 439/108 |
| 5,195,899 | 3/1993 | Yatsu et al. | 439/101 |
| 5,224,867 | 7/1993 | Ohtsuki et al. | 439/108 |
| 5,525,067 | 6/1996 | Gatti | 439/108 |

*Primary Examiner*—Edgar Burr
*Assistant Examiner*—Amanda B. Sandusky
*Attorney, Agent, or Firm*—Fliesler, Dubb, Meyer & Lovejoy

[57] ABSTRACT

A plug in daughtercard with an edge connector having pins configured to maintain a low impedance power supply path and accurately control the impedance of lines carrying signals. A low impedance power supply path is provided with pins of the daughtercard organized in rows and columns with some rows providing all power supply voltage and ground return contact pins extending across the entire daughtercard edge. Rows providing power supply voltage and ground return are further interleaved between rows providing signal path connection pins to maximize the number of power supply voltage and return pins to assure a low impedance power supply path is provided to components throughout a daughtercard. Signal line impedance matching is provided using the rows of pins providing the power supply voltage and ground return connections. Ground return pins in such rows are coupled through metal plates which simulate a larger metal ground plane. Signal pins are then routed between the metal plates so that the metal plates serve as ground planes for AC signal carried through the pins. The distance between the signal pins and the metal plates are adjusted to provide a desired ground plane separation for impedance matching.

11 Claims, 3 Drawing Sheets

| | Row | | | | | |
|---|---|---|---|---|---|---|
| Column | A | B | C | D | E | F |
| 1 | s | G | s | s | + | s |
| 2 | s | + | s | s | G | s |
| 3 | s | G | s | s | + | s |
| 4 | s | + | s | s | G | s |
| ⋮ | ⋮ | ⋮ | ⋮ | ⋮ | ⋮ | ⋮ |
s=signal
G=ground return
+=supply voltage
FIG. 1
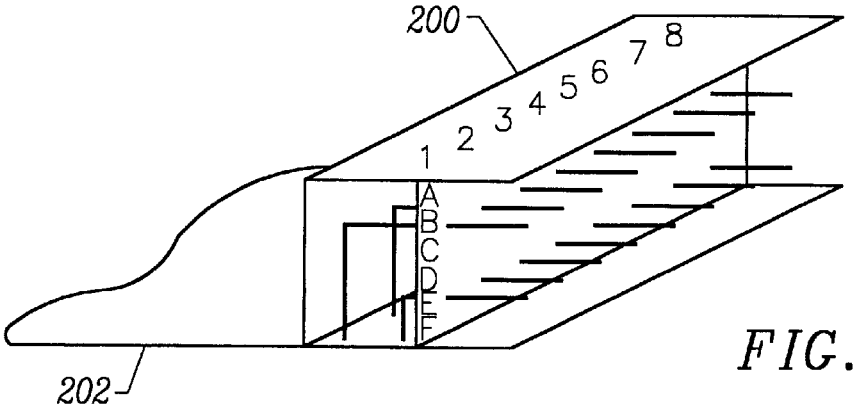
FIG. 2
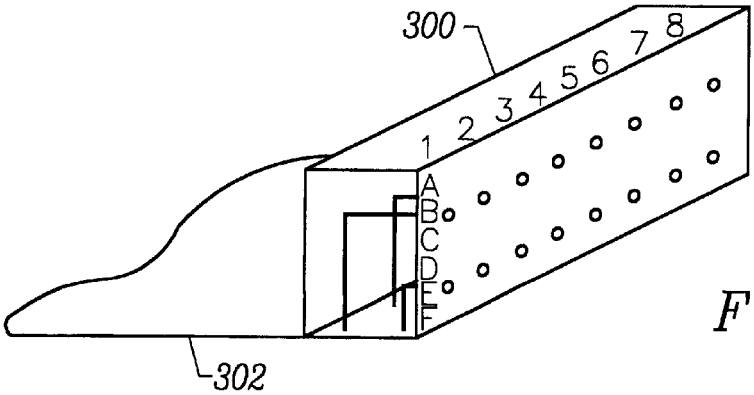
FIG. 3

INTERLEAVED POWER AND IMPEDANCE CONTROL USING DAUGHTERCARD EDGE CONNECTOR PIN ARRANGEMENT

BACKGROUND OF THE INVENTION

1. Field of the Invention

The present invention relates to applying power to a daughtercard to maintain a low impedance power supply path and to accurately control the impedance of lines carrying signals. More particularly, the present invention relates to applying such power to daughtercards utilized in a telephone signal distribution bank.

2. Description of the Background Art

A signal distribution bank used by telephone companies includes shelves or slots on a backplane for connecting daughtercards. The daughtercards include "multiplexer" cards for switching signals provided to the distribution bank, and "distribution" cards, for transferring signals from the distribution bank to remote users or subscribers. With such signal distribution banks, telephone companies can start with only a few daughtercard slots occupied and later fill in the remainder. One such signal distribution bank is the Litespan® LS2012 manufactured by DSC Communications Corporation, Plano Tex.

Power is typically supplied to the daughtercard from power supplies provided on the backplane. To minimize power supply noise, it is desirable to provide a low impedance path from the power supply of the backplane to components of the daughtercard. Typically, a limited number of pins on a daughtercard are utilized to provide power from the backplane because it is desirable to utilize as many pins as possible to carry signals to and from the backplane. With a limited number of power supply pins, components located farther from a power supply pins will have a longer line length carrying power, the longer line length increasing impedance. With increasing line impedance, power supply voltage provided to components on the daughtercard will decrease. Thresholds of components receiving power from longer lines with less voltage will then be reached later than thresholds of components with shorter power supply lines and higher voltages. With thresholds reached at different times, data and clock signal transitions can occur in an asynchronous manner potentially causing errors. Further, with higher impedance power supply lines, when data and clock signals transition, greater noise will be created on the power supply lines which can affect other components on the daughtercard, as well as the power supply signals provided from the backplane itself.

To limit noise created in high frequency signal lines separate from the power supply lines, it is further desirable to have the lines carrying signals between the backplane and the daughtercard have a uniform impedance. With signals switching at a high frequency, signal lines on the daughtercard and backplane are typically provided with line widths and separation from a ground plane set to maintain line impedance at a desired value. With pins connecting the backplane and daughtercard without a ground plane to control impedance, an undesirable impedance mismatch may occur creating signal noise.

SUMMARY OF THE INVENTION

The present invention is a daughtercard with an edge connector having pins configured to provide a low impedance power supply path and accurately control the impedance of lines carrying signals.

Pins of the daughtercard edge connector are organized in rows and columns with some rows providing all power supply voltage and ground return contact pins. This enables a low impedance power supply path to be provided across the entire daughtercard edge. With power supply voltage and ground pins provided across the daughtercard edge, power supply line lengths to each component on a daughtercard will be substantially uniform, and each power supply line path will be minimized to limit line impedance and noise. Rows providing power supply voltage and ground return are further interleaved between rows providing signal path connection pins to maximize the number of pins providing power supply voltage and ground return to assure a low impedance power supply path is provided to components throughout a daughtercard.

The present invention further provides impedance matching to signal line connection pins to limit signal noise. Signal line impedance matching is provided using the rows of pins providing the power supply voltage and ground return connections. Ground return pins in such rows are coupled through small metal plates which simulate larger metal ground planes. Signal pins are then routed between the metal plates so that the metal plates serve as ground planes for AC signals carried through the signal pins. The distance between the signal pins and the metal plates are adjusted to provide a desired ground plane separation for impedance matching.

BRIEF DESCRIPTION OF THE DRAWINGS

Further details of the present invention are explained with the help of the attached drawings in which:

FIG. 1 shows connections to an edge connector for the present invention;

FIG. 2 shows the contacts of rows B and E of FIG. 1 as pins included in an edge connector of a daughtercard;

FIG. 3 shows the contacts of rows B and E of FIG. 1 as sockets included in an edge connector of a daughtercard;

DETAILED DESCRIPTION

Figure 4:
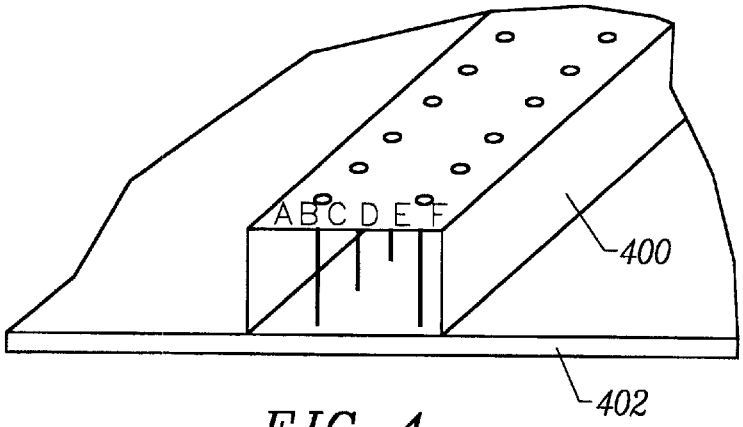
FIG. 4 shows an edge connector as connected to a backplane.

FIG. 1 shows connections to an edge connector for the present invention. Contacts of the edge connector are arranged into rows A–F and columns 1 and higher. Rows B and E provide connections to power supply voltage and ground return lines. The power supply voltage and ground return line pins of row B and E are provided in an alternating fashion across the entire edge connector. Rows A, C, D and F provide connections to signal lines. The rows B and E are interleaved between rows A, C, D and F so that each row of contacts providing signals is adjacent to a row of contacts providing power supply voltage and ground return. Although the supply voltage and ground return contacts are provided in an alternating fashion in FIG. 1, the connections could be redistributed for the present invention, such as with pairs of ground return contacts alternating with pairs of voltage contacts, as long as power supply voltage and ground contacts are evenly distributed across the entire daughtercard edge.

FIG. 2 shows the contacts of rows B and E of FIG. 1 as pins included in an edge connector 200 connected to a printed circuit (PC) board 202 of a daughtercard. For convenience in identifying pins of rows B and E, the remaining rows of pins A, C, D and F are labeled, but not shown. All pins of rows B and E are assumed to be connected to either power supply voltage or ground return lines as indicated with respect to FIG. 1 to evenly distribute power across an entire daughtercard edge.

FIG. 3 shows the contacts of rows B and E of FIG. 1 as sockets included in an edge connector 300 connected to a PC board 302 of a daughtercard. For the present invention, an edge connector of the daughtercard may include either pins as shown in FIG. 2, or sockets as shown in FIG. 3, with the opposing connector being provided on a backplane, as long as power supply voltage and ground return pins are distributed across an entire edge of the daughtercard edge connector. Again, in FIG. 3, for convenience in identifying the sockets of rows B and E, rows A, C, D and F are labeled, but corresponding pins are not shown.

FIG. 4 shows a portion of a connector 400 as connected to a PC board 402 of a backplane. The connector 400 has a configuration opposing the edge connector 200 of FIG. 2 with power supply and ground return pins distributed across the connector 400. Although shown as having sockets, the connector 400 can include pins to enable mating with connector 300 of FIG. 3.

Figure 5:
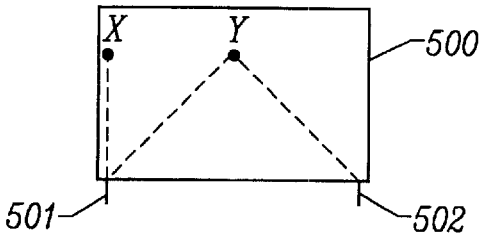
FIG. 5 illustrates the effect of power supply contacts provided only at corners of a daughtercard edge connector.
Figure 6:
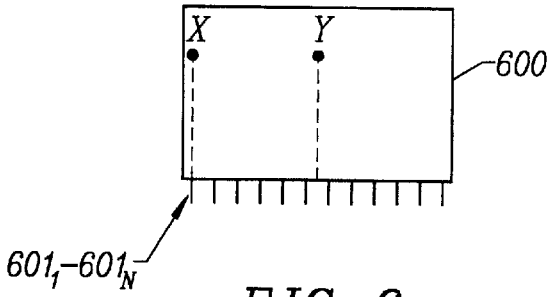
FIG. 6 illustrates the effect of power supply contacts provided across the entire edge of a daughtercard edge connector.

FIGS. 5 and 6 illustrate the effect of providing power supply contacts only at corners of a daughtercard edge connector as opposed to providing power supply contacts across the entire daughtercard edge connector. In FIG. 5, power supply contacts 501 and 502 are provided only at corners of the edge connector. A chip located at point X on the daughtercard 500 of FIG. 5 can be connected to power supply contacts with a minimal length line as illustrated by the dashed line from X to contact 501. However, if a chip is located at a point Y, a longer line is required to provide power from contact 501 as illustrated by the line from point Y to contact 501.

In FIG. 6, power supply contacts $\mathbf{601}_1$–$\mathbf{601}_N$ are provided across the entire edge connector. With contacts so provided in FIG. 6, power can be provided to a chip located at either point X or point Y on daughtercard 600 with a minimal length line as illustrated by the dashed line from points X and Y to individual ones of contacts $\mathbf{601}_1$–$\mathbf{601}_N$.

With minimal length lines, line impedance will be minimized and a more uniform voltage will be received by all components on a daughtercard. With line impedance minimized, voltage transients will have improved supply and return paths from power supplies to components on a daughtercard, and power supply noise will be reduced. With a more uniform voltage, thresholds of components on a daughtercard will be more uniform so that data and clock signal errors are less likely.

Power supply contacts can be provided across the entire edge of a daughtercard using only one of rows B or E, according to the present invention. However, by utilizing multiple rows of contacts to provide power, such as B and E combined, more contacts will be provided to carry the same power, so an even lower impedance path will be provided than with only one row of contacts.

Figure 7:
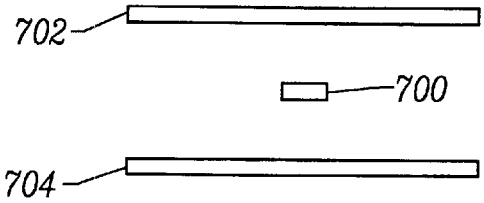
FIG. 7 shows a cross section of a printed circuit board of a daughtercard where a signal line is provided.

FIG. 7 shows a cross section of a PC board of a daughtercard where a signal line 700 is provided. The line 700 if located in the interior layers of the daughtercard will typically be surrounded by two ground planes 702 and 704 which are separated from the line by a dielectric material. With a line such as 700 located on an exterior layer of the daughtercard, the line might be separated from only one ground plane by a dielectric layer.

With a signal provided on a line 700 switching at a high frequency or carrying alternating current (AC), it is desirable that the impedance of the line 700 be accurately controlled. With the line 700 between two ground planes 700 and 704, a stripline configuration occurs. For stripline, impedance can be controlled by setting the width of line 700, its separation from ground planes 702 and 704 and the dielectric constant of material separating the line 700 and ground planes 702 and 704. With the line 700 being separated from only one ground plane by a dielectric, a microstrip configuration occurs. For microstrip, impedance can be controlled by setting the line width, its separation from a ground plane and the dielectric constant of material separating the line and its ground plane.

Although impedance can be controlled within the daughtercard itself, with pins typically used to carry DC signals provided in the edge connector, and no separating ground plane, an impedance mismatch can occur between the daughtercard and backplane.

Figure 8:
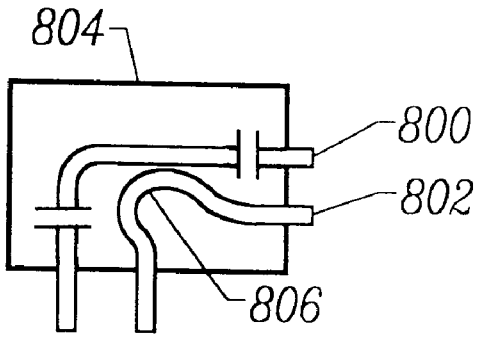
FIG. 8 shows a side view of contacts of an edge connector with components configured to provide a ground plane to contacts carrying AC signals.

FIG. 8 shows a side view of contacts of an edge connector as shown in FIGS. 2 and 3 with components configured to provide a ground plane to contacts carrying AC signals. The contact 800 is assumed to be in a row of pins carrying power supply voltage or ground return. Contact 802 is provided in a row of contacts carrying AC signals. Attached to the contact 800 is a flat metal plate 804. The metal plate 804 serves as a ground plane to signals provided on line 802. The metal plate 804 also effectively increases the size of contact 800 to reduce impedance to further enable a low impedance path to be provided for power supply voltage or ground return. Although the metal plate is shown as a separate plate attached to contact 800, contact 800 could be initially formed to have a flattened portion serving as plate 804 made integrally with a pin portion.

The signal contact 802 may include a curved in area 806 to be placed more central to the metal plate 804 so that metal plate 804 more effectively serves as a ground plane for signals provided on contact 802. The signal contact 802 can also be made without curved portion 806 if the metal plate 804 is appropriately sized to still function as a ground plane.

Figure 9:
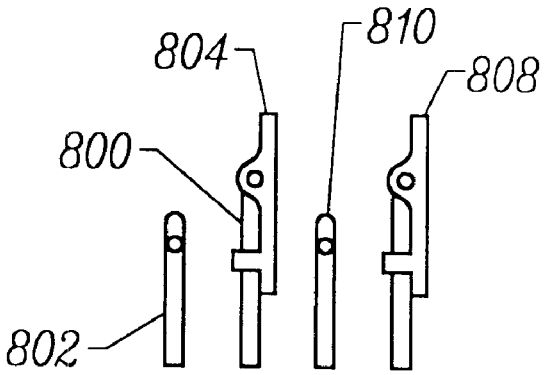
FIG. 9 shows a front view of contacts configured as shown in FIG. 8.

FIG. 9 shows a front view of two sets of contacts configured as shown in FIG. 8. As shown, with the contact 802 being separated from only one metal plate 804, the contact 802 can serve to simulate a microstrip line with spacing between contact 802 and the metal plate 804 appropriately controlled. Signal contact 810 provided between two metal plates 804 and 808 can serve to simulate a stripline line with spacing between contact 810 and metal plates 804 and 808 appropriately controlled.

The contacts 800, 802, and 810 of FIG. 9 and can be either pins of an edge connector, as shown in FIG. 2, or sockets as shown in FIG. 3. With a daughtercard edge connector mating with a backplane edge connector as shown in FIG. 4, both edge connectors can include metal plate ground planes as shown in FIG. 9 to insure appropriate impedance matching. Further, contacts such as 800 to which metal plates are attached can be connected to lines providing either a power supply voltage or ground return since a DC voltage will not significantly affect the AC ground plane characteristics.

Although the present invention has been described above with particularity, this was merely to teach one of ordinary skill in the art how to make and use the invention. Many other modifications will fall within the scope of the invention, as that scope is defined by the claims provided below.

What is claimed is:

1. A plug in card with an edge connector comprising:

pin arranged in rows and columns for mating with a backplane connector;

signal lines connected to pins in first ones of the rows;

voltage supply lines connected to first pins in second ones of the rows; and return lines connected to second pins in the second rows, wherein the first and second pins make up substantially all pin the second rows, and wherein the first and second pins of the second rows are provided in an alternating fashion in each of the second rows.

2. The plug in card of claim 1, wherein the second rows are interleaved between the first rows.

3. The plug in card of claim 1 further comprising:

ground plane regions coupled to given ones of the pins in the second rows, wherein pin in the first rows are provided with a distance relative to the ground plane regions so that the ground plane regions serve as ground planes for alternating current signals provided through pins of the first rows.

4. The plug in card of claim 3, wherein each of the first rows is provided adjacent to at least one of the second rows.

5. The plug in card of claim 3, wherein the given contacts in the second rows are connected to the return lines.

6. A backplane connector comprising:

sockets arranged in rows and columns for mating with a connector of a plug in card;

signal lines connections to sockets in first ones of the rows;

voltage supply line connections to first sockets in second ones of the rows; and return lines connections to second sockets in the second rows, wherein the first and second sockets make up substantially all contacts in the second rows, and wherein the first and second sockets of the second rows are provided in an alternating fashion in each of the second rows.

7. A plug in card with an edge connector comprising:

sockets arranged in rows and columns for mating with a backplane connector;

signal lines connected to sockets in first ones of the rows;

voltage supply lines connected to first sockets in second ones of the rows; and return lines connected to second sockets in the second rows, wherein the first and second sockets make up substantially all sockets in the second rows, and wherein the first and second sockets of the second rows are provided in an alternating fashion in each of the second rows.

8. A backplane connector comprising:

pins arranged in rows and columns for mating with a connector of a plug in card;

signal lines connections to pins in first ones of the rows;

voltage supply line connections to first pins in second ones of the rows; and return lines connections to second pins in the second rows, wherein the first and second pins make up substantially all contacts in the second rows, and wherein the first and second pins of the second rows are provided in an alternating fashion in each of the second rows.

9. The backplane connector of claim 8, wherein the second rows are interleaved between the first rows.

10. The backplane connector of claim 8 further comprising:

ground plane regions coupled to given ones of the pins in the second rows, wherein pins in the first rows are provided with a distance relative to the ground plane regions so that the ground plane regions serve as ground planes for alternating current signals provided through pins of the first rows.

11. The backplane connector of claim 10, wherein each of the first rows is provided adjacent to at least one of the second rows.

* * * * *